US005803710A

United States Patent [19]

Dietrich et al.

[11] Patent Number: 5,803,710

[45] Date of Patent: Sep. 8, 1998

[54] TURBINE ENGINE ROTOR BLADE PLATFORM SEALING AND VIBRATION DAMPING DEVICE

[75] Inventors: Douglas J. Dietrich, West Palm Beach, Fla.; Alan W. Stoner, Tullahoma, Tenn.; David J. Wiebe, Palm Beach Shores, Fla.

[73] Assignee: United Technologies Corporation, Hartford, Conn.

[21] Appl. No.: 772,838

[22] Filed: Dec. 24, 1996

[51] Int. Cl.[6] ..... F04D 29/34

[52] U.S. Cl. ..... 416/248; 416/500

[58] Field of Search ..... 416/190, 193 A, 416/248, 500

[56] References Cited

U.S. PATENT DOCUMENTS

| | | | |
|---|---|---|---|
| 4,422,827 | 12/1983 | Buxe et al. | 416/193 A |
| 5,228,835 | 7/1993 | Chlus | 416/193 A |
| 5,284,421 | 2/1994 | Chlus et al. | 416/248 |
| 5,313,786 | 5/1994 | Chlus et al. | 426/500 |
| 5,414,526 | 5/1995 | Mercadante et al. | 416/500 |
| 5,460,489 | 10/1995 | Benjamin et al. | 416/248 |
| 5,513,955 | 5/1996 | Barcza | 416/95 |

*Primary Examiner*—John T. Kwon
*Attorney, Agent, or Firm*—Richard D. Getz

[57] ABSTRACT

A device for sealing between and damping of adjacent rotor blade platforms is provided which includes a forward seal member, a compliant center seal member, an aft seal member, a first damper, and a second damper. The first damper is disposed between the forward and compliant center seal members, and the second damper is disposed between the compliant center and aft seal members. The compliant center seal member is disposed between the first and second dampers. The compliant center seal member accommodates misalignment between adjacent rotor blade platforms by deflecting in response to centrifugal forces acting on the dampers.

8 Claims, 1 Drawing Sheet

FIG. 1
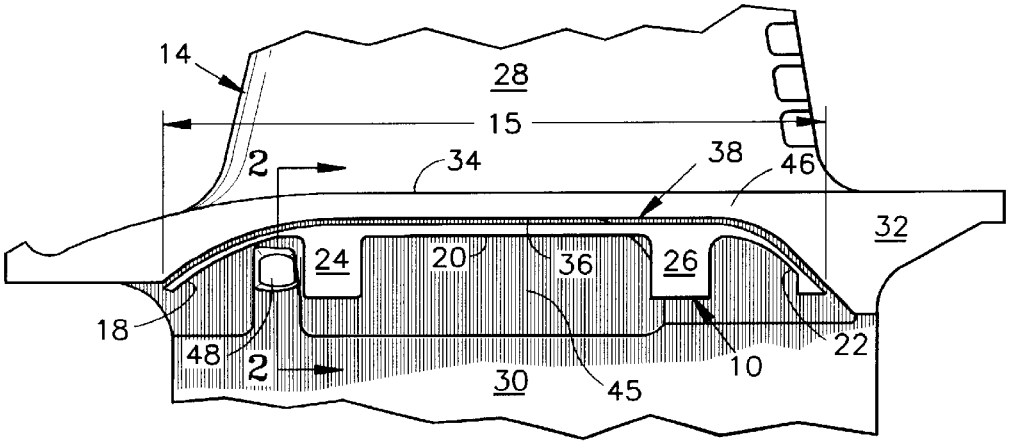
FIG. 2
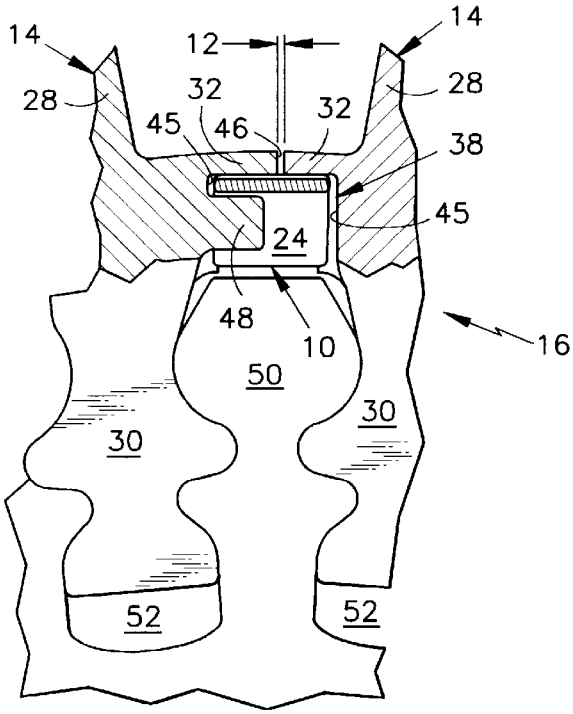
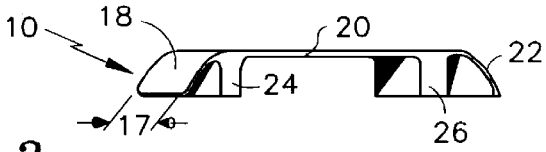
FIG. 3

TURBINE ENGINE ROTOR BLADE PLATFORM SEALING AND VIBRATION DAMPING DEVICE

The invention was made under a U.S. Government contract and the Government has rights herein.

BACKGROUND OF THE INVENTION

1. Technical Field

This invention applies to turbine engine rotor assemblies in general, and to devices for sealing between and damping of adjacent rotor blades in particular.

2. Background Information

Turbine and compressor sections within an axial flow turbine engine generally include a rotor assembly comprising a rotating disk and a plurality of rotor blades circumferentially disposed around the disk. Each rotor blade includes a root, an airfoil, and a platform positioned in the transition area between the root and the airfoil. The roots of the blades are received in complementary shaped recesses within the disk. The platforms of the blades extend laterally outward and collectively form a flow path for the fluids passing through the rotor assembly. A person of skill in the art will recognize that it is a distinct advantage to control the passage of fluid from one side of the platforms to the other side of the platforms via gaps between the platforms. To that end, it is known to place a seal between the blade platforms to control such fluid leakage.

During operation, blades may be excited into vibration by a number of different forcing functions. Gas exiting upstream turbine and/or compressor sections in a periodic, or "pulsating" manner, for example, can excite vibrations throughout the rotor assembly. Left unchecked, vibration can cause blades to fatigue prematurely and consequently decrease the allowable life of the blades. Forward is defined as being upstream of aft within the engine.

A person of skill in the art will recognize that it is known to provide means for damping the vibratory motion of rotor blades within a turbine engine rotor assembly. In some prior art embodiments, a seal provides a secondary function as a damper, or conversely a damper provides a secondary function as a seal. Either way, a person of skill in the art will recognize it is unlikely that the seal will provide optimum damping or that the damper will provide optimum sealing. In other embodiments, the damper and the seal are independent of one another. The damper is positioned to act against a surface located between the platform and the root and the seal is positioned between the damper and the platforms. A disadvantage of this approach is that often the seal must be installed blindly after adjacent blades are installed in the disk. Seals which are slid in blindly require guiding means, usually in the form of additional surfaces cast in the rotor blade.

In sum, what is needed is a means for damping vibrations in a turbine engine rotor assembly and a means for sealing between adjacent rotor blades which overcomes the aforementioned disadvantages and problems.

DISCLOSURE OF THE INVENTION

It is, therefore, an object of the present invention to provide a means for damping vibrations in a turbine engine rotor assembly.

It is another object of the present invention to provide a means for sealing between adjacent rotor blades.

It is still another object of the present invention to provide a sealing and damping device that facilitates rotor assembly installation.

It is still another object of the present invention to simplify the shape of each cast turbine engine rotor blade.

According to the present invention, a device for sealing between, and damping of, adjacent rotor blade platforms is provided which includes a forward seal member, a compliant center seal member, an aft seal member, a first damper, and a second damper. The first damper is disposed between the forward and compliant center seal members, and the second damper is disposed between the compliant center and aft seal members. The compliant center seal member is disposed between the first and second dampers. The compliant center seal member accommodates misalignment between adjacent rotor blade platforms by deflecting in response to centrifugal forces acting on the dampers. The compliance, or flexibility, of the center seal member enables the dampers and seal members to remain in contact with the misaligned platforms. The result is effective sealing between, and damping of, the misaligned adjacent rotor blade platforms.

According to one aspect of the present invention, a locating stub extends out from the blade between the platform and the root. The locating stub positions the sealing and damping device relative to the blade platforms.

An advantage of the present situation is that effective sealing can be provided between adjacent misaligned rotor blades, at the same time as effective damping. The mass of the first and second dampers forced radially outward by centrifugal force maintains the present invention sealing and damping device in contact with the misaligned adjacent blade platforms. The contact between the device and the misaligned platforms ensures sealing between, and damping of, the misaligned adjacent platforms.

Another advantage of the present invention is that the sealing and damping device enables the shape of each cast rotor blade to be simplified. A "cleaner" casting costs less to cast and is easier to later machine. For example, the sealing and damping device obviates the need for additional surfaces for the damper to act against, as well as obviating the need for the guide surfaces necessary when the seal is installed blindly. As a result, each rotor blade has less stress risers. A person of skill in the art will recognize that it is a significant advantage to reduce the number of stress risers in a rotor blade.

Still another advantage of the present invention is that installation of a rotor assembly is facilitated. Specifically, the locating stub extending out from the blade positively locates the monopiece present invention sealing and damping device and the geometry of the sealing and damping device obviates the need for multiple guide surfaces.

These and other objects, features and advantages of the present invention will become apparent in light of the detailed description of the best mode embodiment thereof, as illustrated in the accompanying drawings.

BRIEF DESCRIPTION OF THE DRAWINGS

FIG. 1 is a diagrammatic view of the present invention installed adjacent the root side of a rotor blade.

FIG. 2 is a sectional view of present invention disposed between adjacent rotor blades mounted in a disk.

FIG. 3 is an diagrammatic perspective view of the present invention sealing and damping device.

BEST MODE FOR CARRYING OUT THE INVENTION

Referring to FIGS. 1–3, a device 10 for sealing the gap 12 (see FIG. 2) between, and damping vibrations of, adjacent blades 14 in a gas turbine engine rotor assembly 16 is shown having a length 15 (FIG. 1) and a width 17 (FIG. 3). The device 10 includes a forward seal member 18, a compliant center seal member 20, an aft seal member 22, a first damper 24, and a second damper 26. The first damper 24 is disposed between the forward 18 and compliant center 20 seal members, and the second damper 26 is disposed between the compliant center 20 and the aft 22 seal members. The compliant center seal member 20 is disposed between the first 24 and second 26 dampers. The first 24 and second 26 dampers are attached to the compliant center seal member 20, spaced apart from one another along the length 17 of the device 10.

Each rotor blade 14 includes an airfoil 28, a root 30, and a platform 32. The platform 32 extends laterally (i.e., in a circumferential direction) outward in the transition area between the root 30 and the airfoil 28, and may be described as having an airfoil side 34 and a root side 36. The root side 36 of each platform 32, on either circumferential side of the root 30, includes a pocket 38 for receiving the sealing and damping device 10. The lateral depth of the pocket 38 is chosen such that when the sealing and damping device 10 is adjacent the side wall 45 of the pocket 38, approximately half the width 17 of the sealing and damping device 10 extends beyond the lateral edge 46 of the platform 32. A locating stub 48 extends out from the blade 14 between the platform 32 and the root 30 of the blade 14.

Referring to FIG. 2, a section of a rotor blade assembly 16 includes a pair of adjacent blades 14 mounted in a disk 50. The disk 50 includes a plurality of recesses 52 distributed around the circumference of the disk 50 for receiving the roots 30 of the blades 14. FIG. 2 shows the roots 30 and recesses 52 having a conventional fir tree configuration. Other blade attachment schemes may be used alternatively. The platforms 32 of the adjacent blades 14 are separated by gap 12. The present invention sealing and damping device 10 is located radially inside of the root side 36 of the adjacent platforms 32.

In the operation of the rotor assembly 16, the disk 50 and attached rotor blades 14 of the rotor assembly 16 rotate about an "axis of rotation". The rotational speed of the rotor assembly 16 around the axis of rotation directly relates to the centrifugal forces acting on the rotor blades 14 and sealing and damping devices 10 disposed between the blades 14. The centrifugal forces force the sealing and damping devices 10 into contact with root side 36 surfaces of adjacent blade platforms 32 within the rotor assembly 16. The first 24 and second 26 dampers of each sealing and damping device 10, in contact with the adjacent platforms 32, damp blade vibrations via frictional damping of the blade platforms 32, and to a lesser extent by changing the effective mass of the platform 32. At the same time, the forward 18, center 20, and aft 22 seal members, also in contact with the adjacent platforms 32, prevent or minimize gas passage through the gap 12 between the platforms 32.

Non-uniform loads on adjacent blades 14, such as forcing functions emanating from gas passing by the airfoils 28, can cause misalignment between adjacent rotor blades platforms 32. To avoid leakage and/or a diminishment of damping, the compliant center seal member 20 deflects to accommodate the misalignment. Specifically, the centrifugal forces acting on the first 24 and second 26 dampers forces the compliant center seal member 20 and dampers 24,26 in to contact with the platforms 32 of the adjacent blades 14, thereby providing effective sealing and damping despite the misalignment between the adjacent blade platforms 32. In the preferred embodiment, the forward 18 and aft 22 seal members are sufficiently compliant to accommodate any misalignment that occurs between the platform pocket 38 surfaces they act against. The mass of each damper 24,26 and the compliance, or flexibility, of the seal members 18,20,22 can be adjusted to suit the application at hand.

Although this invention has been shown and described with respect to the detailed embodiments thereof, it will be understood by those skilled in the art that various changes in form and detail thereof may be made without departing from the spirit and scope of the claimed invention.

We claim:

1. An apparatus for sealing between and damping adjacent rotor blade platforms, comprising:

a forward seal member, having a width;

a compliant center seal member, having a width;

a first damper, disposed between said forward and compliant center seal members;

an aft seal member, having a width; and a second damper, disposed between said center seal member and said aft seal member;

wherein said compliant center seal member is disposed between said first and second dampers; and wherein said compliant center seal member selectively deflects to accommodate misalignment between the adjacent rotor blade platforms, thereby enabling said first and second dampers to remain in contact and damp said misaligned adjacent rotor blade platforms.

2. An apparatus according to claim 1, wherein said forward seal member is sufficiently compliant to accommodate said misaligned adjacent rotor blade platforms.

3. An apparatus according to claim 2, wherein said aft seal member is sufficiently compliant to accommodate said misaligned adjacent rotor blade platforms.

4. An apparatus according to claim 3, wherein first and second dampers extend across said width of said compliant seal member.

5. An apparatus for sealing between and damping adjacent rotor blade platforms, comprising:

compliant seal member, having a width and a length;

a first damper, attached to said compliant seal member; and a second damper, attached to said compliant seal member;

wherein said first and second dampers are spaced apart from one another along said length of said compliant seal member; and wherein said compliant seal member selectively deflects to accommodate misalignment between the adjacent rotor blade platforms, thereby enabling said first and second dampers to remain in contact and damp said misaligned adjacent rotor blade platforms.

6. An apparatus according to claim 5, wherein said first and second dampers are attached to a first side of said compliant seal member.

7. An apparatus according to claim 6, wherein first and second dampers extend across said width of said compliant seal member.

8. A gas turbine rotor assembly, comprising:

a plurality of rotor blades, each blade having an airfoil, a root and a platform extending out laterally between said airfoil and said root;

a disk, for rotation around a rotational axis, having a plurality of recesses positioned around a circumference of said disk, wherein each said rotor blade root is received within one of said recesses;

a plurality of sealing and damping devices, each device having a forward seal member;

a compliant center seal member;

a first damper, disposed between said forward and compliant center seal members;

an aft seal member; and second damper, disposed between said center seal member and said aft seal member;

wherein said compliant center seal member is disposed between said first and second dampers; and wherein said compliant center seal member selectively deflects to accommodate misalignment between the adjacent rotor blade platforms, thereby enabling said first and second dampers to remain in contact and damp the misaligned adjacent rotor blade platforms.

* * * * *